US006003719A

United States Patent [19]

Stewart, III

[11] Patent Number: 6,003,719

[45] Date of Patent: Dec. 21, 1999

[54] COOLING CONTAINER THAT INCLUDES A RADIANT HEAT BARRIER

[76] Inventor: John R. Stewart, III, 1946 Marquis CT, Chula Vista, Calif. 91913

[21] Appl. No.: 09/169,716

[22] Filed: Oct. 9, 1998

[51] Int. Cl.[6] ..... B65D 25/14

[52] U.S. Cl. ..... 220/592.21; 220/592.11; 220/915.2

[58] Field of Search ..... 220/592.26, 915.2, 220/592.02, 592.03, 592.09, 592.1, 592.11, 62.13, 62.18, 62.22, 915.1, 592.27, 592.25, 592.2, 592.21; 62/457.7

[56] References Cited

U.S. PATENT DOCUMENTS

| | | | |
|---|---|---|---|
| 1,964,795 | 7/1934 | Frary | 220/592.11 |
| 1,973,880 | 9/1934 | Moody | 220/592.26 |
| 3,238,002 | 3/1966 | O'Connell et al. | 220/592.21 |
| 3,791,547 | 2/1974 | Branscum | 220/592.2 |
| 4,537,044 | 8/1985 | Putnam . | |
| 4,917,256 | 4/1990 | Kruck et al. | 220/4.28 |
| 5,064,088 | 11/1991 | Steffes | 220/339 |
| 5,103,651 | 4/1992 | Coelho et al. | 62/341 |
| 5,568,735 | 10/1996 | Newkirk . | |
| 5,570,588 | 11/1996 | Lowe | 62/457.7 |
| 5,671,611 | 9/1997 | Quigley . | |

*Primary Examiner*—Stephen Castellano

[57] ABSTRACT

A cooler assembly for keeping beverages, food, medical supplies, drugs and other heat sensitive products at lower than ambient temperatures. Container includes a radiant heat barrier and air space between an inner and outer shell of a cooler assembly so as to improve the effectiveness of the cooler assembly by minimizing the detrimental effects of radiant heat and conductive heat.

8 Claims, 4 Drawing Sheets

COOLING CONTAINER THAT INCLUDES A RADIANT HEAT BARRIER

BACKGROUND OF THE INVENTION

1. Field of Invention

This invention relates to an improved container for holding beverages, food, and other items that require storage at lower than ambient temperatures.

2. Description of the Prior Art

Beverages, food, medical supplies, drugs and other heat sensitive products requiring storage at lower than ambient temperatures have long been kept in insulated "coolers" or "chests." While these coolers or chests have certainly evolved over the years, none of the prior art designs include the necessary features for effectively keeping contents at lower than ambient temperatures by minimizing the detrimental effects of radiant heat.

For instance, U.S. Pat. No. 5,671,611 to Quigley dated Sep. 30, 1997, U.S. Pat. No. 5,568,735 to Newkirk dated Oct. 29, 1996, and U.S. Pat. No. 4,872,589 to Englehart dated Oct. 10, 1989 each address the issue of preventing melted ice from coming into contact with the contents of the cooler and thereby contaminate the contents or allow the contents to become soggy. Though each of the before mentioned patents provides a novel solution to the expressed problem of preventing melted ice from coming into contact with the contents of the cooler, it is not an object of any of the before mentioned inventions to improve the effectiveness of a cooler by minimizing the detrimental effects of radiant heat. Furthermore, the invention described in U.S. Pat. No. 5,568,735 requires that the entire cooler be placed in a freezer until the refrigerant material within the cooler is frozen. This is a disadvantage in that the typical cooler user does not have a freezer large enough to accept even a relatively small cooler, and that freezers are typically unavailable in locations where coolers are often used such as during remote weekend camping trips.

In U.S. Pat. No. 4,537,044 to Putnam dated Aug. 27, 1985, a more effective "hot" or "cold" food storage container is described which could selectively take advantage of the physical movement of heat or cold. Basically, this food storage container is designed so that a cooling source is placed above the food storage compartment for transferring cold in a descending direction while in the cooling mode of operation. Alternatively, a heat source is placed below the food storage compartment for transferring heat in an ascending direction while in the heating mode of operation. Though it is an object of this invention to improve the effectiveness of a cooler in keeping contents hot or cold, this food storage container does not attempt to improve the effectiveness of a cooler by minimizing the detrimental effects of radiant heat.

Yet another invention described in U.S. Pat. No. 4,498,312 to Schlosser dated Feb. 12, 1985 is designed to maintain products at selected hot or cold temperatures through use of solution filled, slab-like containers and a chest or housing. This invention requires that the slab-like containers, which provide the source of heat or cold, be frozen or heated by an external source such as a freezer or oven. While these slab-like containers are removable from the chest or housing and may therefore be easily placed into a typical freezer or oven, freezers or ovens are not usually available during remote weekend camping trips thereby making use of such a container impractical. Furthermore, it is not an object of this invention to improve the effectiveness of a cooler by minimizing the detrimental effects of radiant heat.

U.S. Pat. No. 5,570,588 to Lowe dated Nov. 5, 1996 is similar in operation to that described in U.S. Pat, No. 4,498,312. Specifically, both coolers employ the use of solution filled, slab-like containers or gel-packs to maintain products at desired temperatures. Here again, the invention described in U.S. Pat. No. 5,570,588 would require that the gel-packs, which in this invention provide the source of cold, be frozen by an external source such as a freezer. While these gel-packs are also removable from the chest or housing and may therefore be placed into a typical freezer, freezers are not usually available during remote weekend camping trips thereby making use of such a container impractical. Furthermore, it is not an object of this invention to improve the effectiveness of a cooler by minimizing the detrimental effects of radiant heat.

The picnic cooler described in U.S. Pat. No. 5,064,088 to Steffes dated Nov. 12, 1991 incorporates a novel lid design that includes an integral hinge that separates the lid into portions. The lid can then be removably attached to the cooler container body and access to the cooler container body can be obtained through either portion of the lid. With the exception of the novel lid design and function, the overall cooler is constructed in a manner that is well known in the prior art. That is, the essentially planer lid is hollow, providing very little insulative value, and the cooler container body is comprised of an inner shell, an outer shell, and a low conductivity insulating material. The purpose of this cooler design is to improve the method of operating the cooler by allowing access to the cooler container body in multiple ways, and without the use of hinges or latches. This invention is not intended to improve the efficiency of the cooler in keeping contents at lower than ambient temperature, nor is it an object of this invention to improve the effectiveness of a cooler by minimizing the detrimental effects of radiant heat.

As the above prior art descriptions suggest, there are many difficulties associated in effectively and efficiently storing heat sensitive products, particularly beverages and food items, at lower than ambient temperatures. This is especially true when such items must be kept at lower than ambient temperatures for greater than a twenty-four hour period, and when such items are located in places where no external power source is available. When this is the case, such as during a remote weekend camping trip, the most practical and reliable means for keeping heat sensitive products, particularly beverages and food items, at lower than ambient temperatures is by storing the items in a cooler, and by using ice for maintaining lower than ambient temperatures within the cooler.

Ice is often used as a source of coldness for keeping items in a cooler at lower than ambient temperatures because ice is readily available for purchase, and is relatively inexpensive. It should be noted, however, that the cumulative expense of purchasing ice over extended periods of time, such as during a weekend camping trip, could be significant. Furthermore, it can be disruptive and inconvenient for the cooler user to break away from the pleasures of camping to visit a store or market to purchase additional ice. For these reasons, a cooler that is more effective and efficient at keeping contents at lower than ambient temperatures would be beneficial to consumers.

Most importantly, none of the before mentioned prior art forms attempt to improve the efficiency and effectiveness of a cooler by minimizing the detrimental effects of radiant heat.

Whatever the precise merits, features and advantages of the above cited references, none of them achieves or fulfills the purposes of the present invention.

OBJECTS AND ADVANTAGES

It is a principle object and advantage of the present invention to incorporate a radiant heat barrier into the construction of a cooler or chest to minimize the detrimental effects of radiant heat and thereby improve the effectiveness of a cooler in keeping contents at lower than ambient temperatures.

It is another object and advantage of the present invention to incorporate an optional air space between the inner and outer shells in the construction of a cooler or chest to minimize the detrimental effects of radiant heat and conductive heat and thereby improve the effectiveness of a cooler in keeping contents at lower than ambient temperatures.

It is another object and advantage of the present invention to incorporate an optional insulating material between the inner and outer shells in the construction of a cooler or chest to minimize the detrimental effects of conductive heat and thereby improve the effectiveness of a cooler in keeping contents at lower than ambient temperatures.

It is another object and advantage of the present invention to incorporate an optional insulating material between the inner and outer shells in the construction of a cooler or chest to minimize the detrimental effects of conductive heat and thereby improve the effectiveness of a cooler in keeping contents at higher than ambient temperatures.

It is another object and advantage of the present invention to improve the efficiency of a cooler or chest as described to reduce the expense of purchasing ice or alternative cold source substances such as dry ice when operating the cooler.

It is another object and advantage of the present invention to improve the efficiency of a cooler or chest as described to reduce the expense of operating an electrically powered cold source, such as an electrical refrigerating system, when an electrically powered cold source is used in conjunction with the cooler.

It is another object and advantage of the present invention to improve the efficiency of a cooler or chest as described to increase the length of time the cooler is capable of effectively keeping its contents at lower than ambient temperatures when utilizing a given cold source.

Another object and advantage of the present invention is that the invention may be manufactured in any desired size and configuration, and may be manufactured from any desired material in order to comply with the needs of the user.

Further objects and advantages of this invention will become apparent from a consideration of the drawings and ensuing description of it.

DRAWING FIGURES

The invention will be best understood, together with additional advantages and objectives thereof, from the following descriptions, read with reference to the drawings in which.

DRAWING REFERENCE NUMERALS

Figure 3:
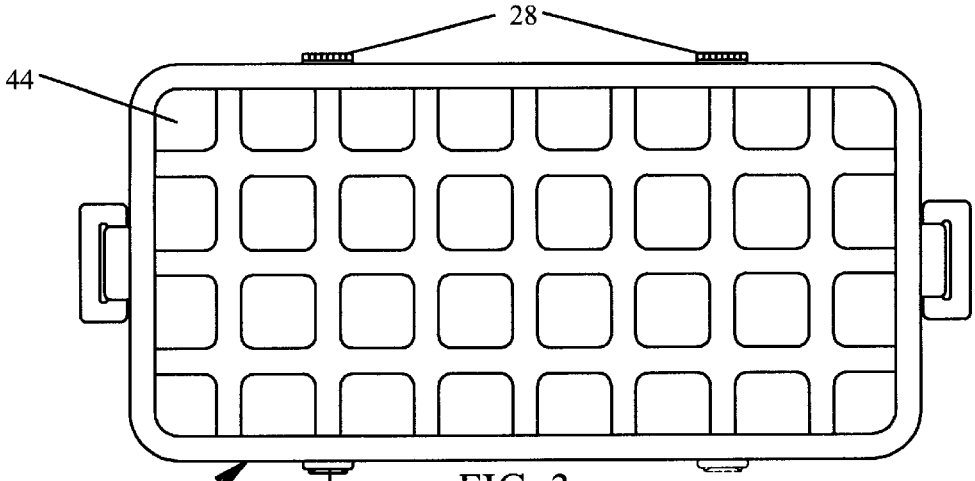
FIG. 3 is a top view of a cooler constructed according to the teachings of the present invention.

10 cooler assembly
12 outer shell
14 radiant barrier
16 air space
18 insulating material
20 inner shell
22 storage area
24 drain plug
26 drain hole
28 hinge
30 latches
32 seal
34 handles
36 handle anchors
38 cooler housing assembly
40 lid assembly
42 female stiffening ridge/interlocking feature
44 male stiffening ridge/interlocking feature
46 tray supporting shoulder
48 seal land
50 spacer blocks
52 tray

DESCRIPTION OF THE INVENTION

Figure 1:
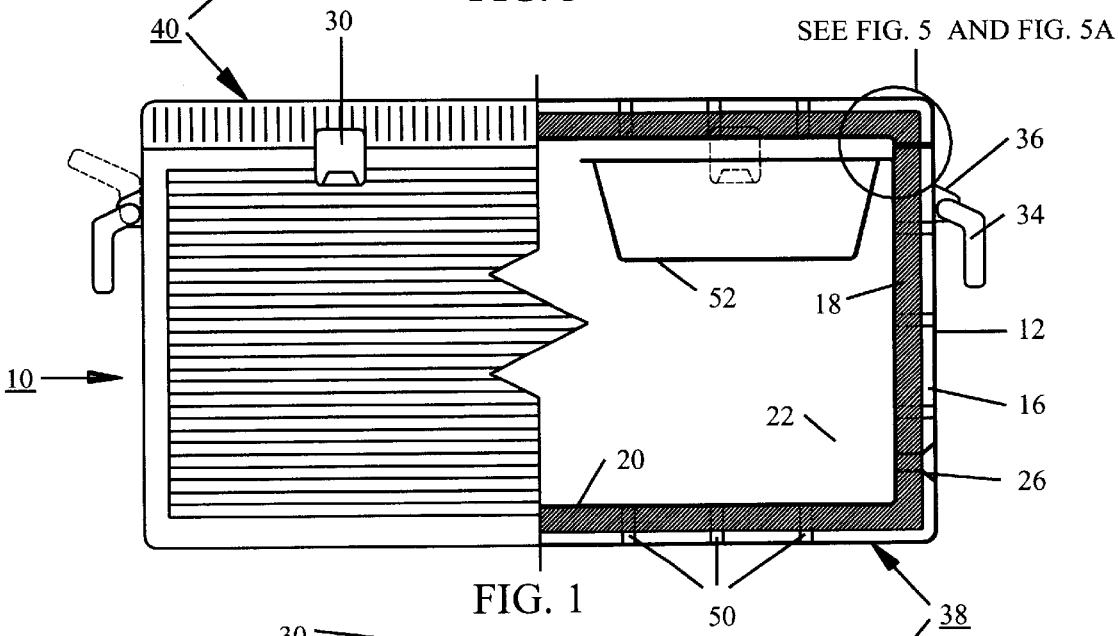
FIG. 1 is a front view of a cooler constructed according to the teachings of the present invention with portions being broken away to illustrate the interior construction of the cooler.

Illustrated in FIG. 1 is a cooler assembly, designated 10, that may be used to store beverages, food, medical supplies, drugs and other heat sensitive products at lower than ambient temperatures. The items requiring storage at less than ambient temperatures are placed in the storage area 22 along with a source of coldness such as ice.

In actuality, an object is maintained "cold" not by any input thereto, but by removing heat therefrom, but for simplification which does not adversely affect an understanding of this invention, an item that is maintained "cold" will be indicated as achieving this condition as a result of input from a source of coldness such as ice.

Figure 5:
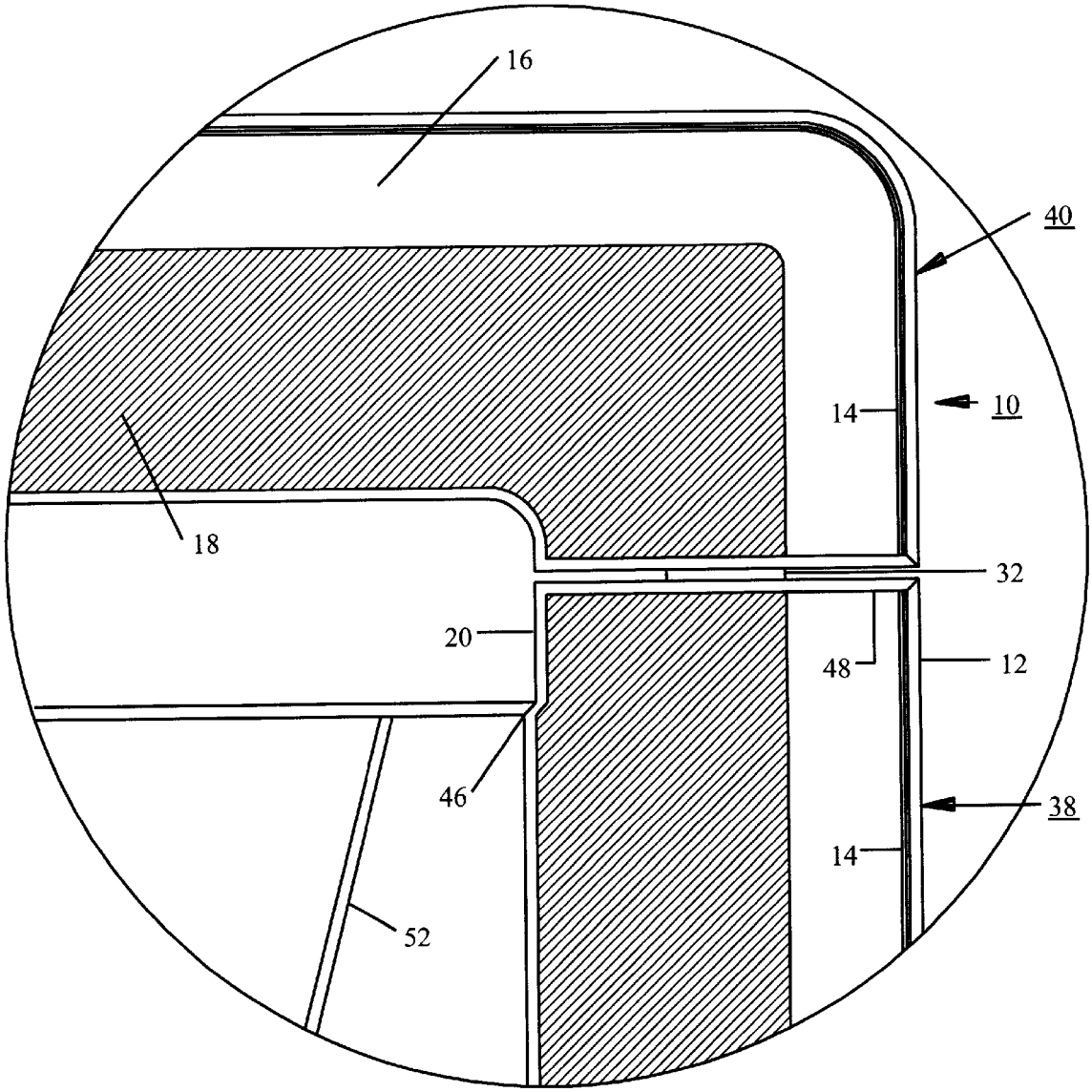
FIG. 5 is an enlarged, sectional view taken from FIG. 1 showing the lid assembly and cooler housing assembly interface and details of a cooler constructed according to the teachings of the present invention.

Referring to FIG. 1 and FIG. 5 cooler assembly 10 is in many respects constructed similarly to the prior art. Accordingly, cooler assembly 10 has a rectangular shaped one-piece inner shell 20 consisting of a horizontal bottom, four vertical walls running perpendicular to the bottom, and a seal land 48 that runs parallel to the bottom. The vertical walls of the inner shell 20 include an integral tray supporting shoulder 46, for supporting a tray 52, which may be used to contain articles of food. The seal land 48 of the inner shell 20 is attached to the top edge of the vertical walls of the one-piece outer shell 12. The one-piece outer shell 12 consists of a horizontal bottom, two end vertical walls, one front vertical wall, and one back vertical wall. Each end vertical wall includes an integral handle anchor 36 which serves as a mounting bracket for a handle 34. The handles 34, are attached to the handle anchors 36 and are movable in an arc of approximately 120 degrees from the solid line position to the broken line position as shown in FIG 1.

Figure 2:
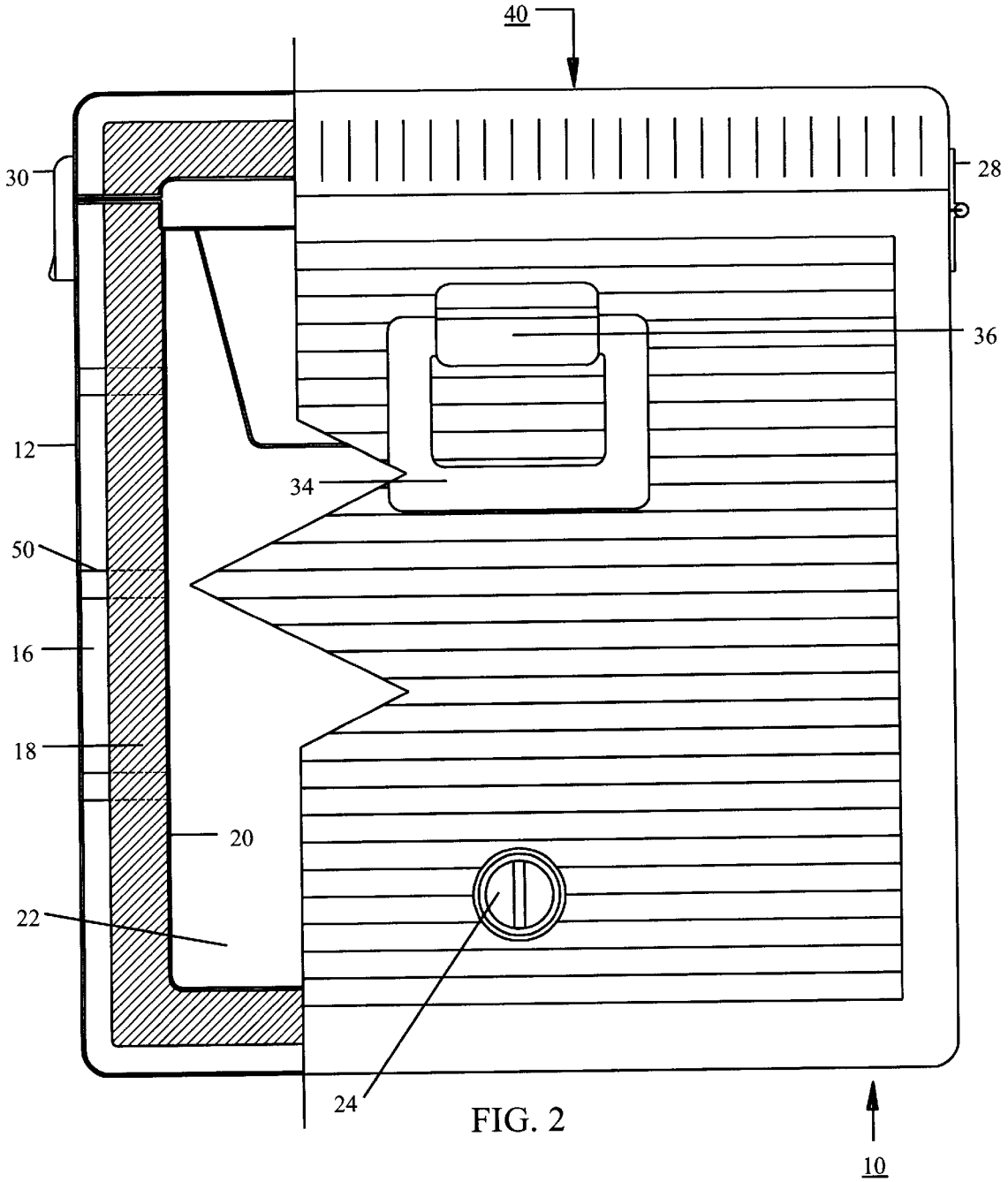
FIG. 2 is a side view of a cooler constructed according to the teachings of the present invention with portions being broken away to illustrate the interior construction of the cooler.

FIG. 1 and FIG. 2 illustrate that the inner shell 20 is preferably spaced apart from the outer shell 12. This spacing configuration is typical for the lid assembly 40, and for the horizontal bottom and all four vertical walls of the cooler housing assembly 38. Spacer blocks 50 attach the inner shell 20 to the outer shell 12 and are strategically placed throughout the lid assembly 40 and cooler housing assembly 38 to prevent the inner shell 20 and outer shell 12 from moving towards each other.

FIG. 5 shows detail of the preferred cooler wall construction that is typical for the lid assembly 40, and for the horizontal bottom and all four vertical walls of the cooler housing assembly 38. This preferred cooler wall construction, as shown in FIG. 5, consists of the outer shell 12, radiant barrier 14, air space 16, insulating material 18, and inner shell 20. Affixed to the inside of the outer shell 12 is a radiant barrier 14 such as the foil-type radiant barriers offered by Innovative Insulation Inc. at 6200 Pioneer Parkway, Arlington, Tex. 76013 and Fi-Foil Company, Inc. at 612 Bridgers Avenue West, Auburndale, Fla. 33823, or the radiant barrier 14 could be of the spray-applied type offered by Solar Energy Corp. at Box 3065, Princeton, N.J. 08543-3065. The radiant barrier 14 is then separated from the insulating material 18, by an air space 16. The insulating material 18 is then affixed to the outside of the inner shell 20.

Figure 5A:
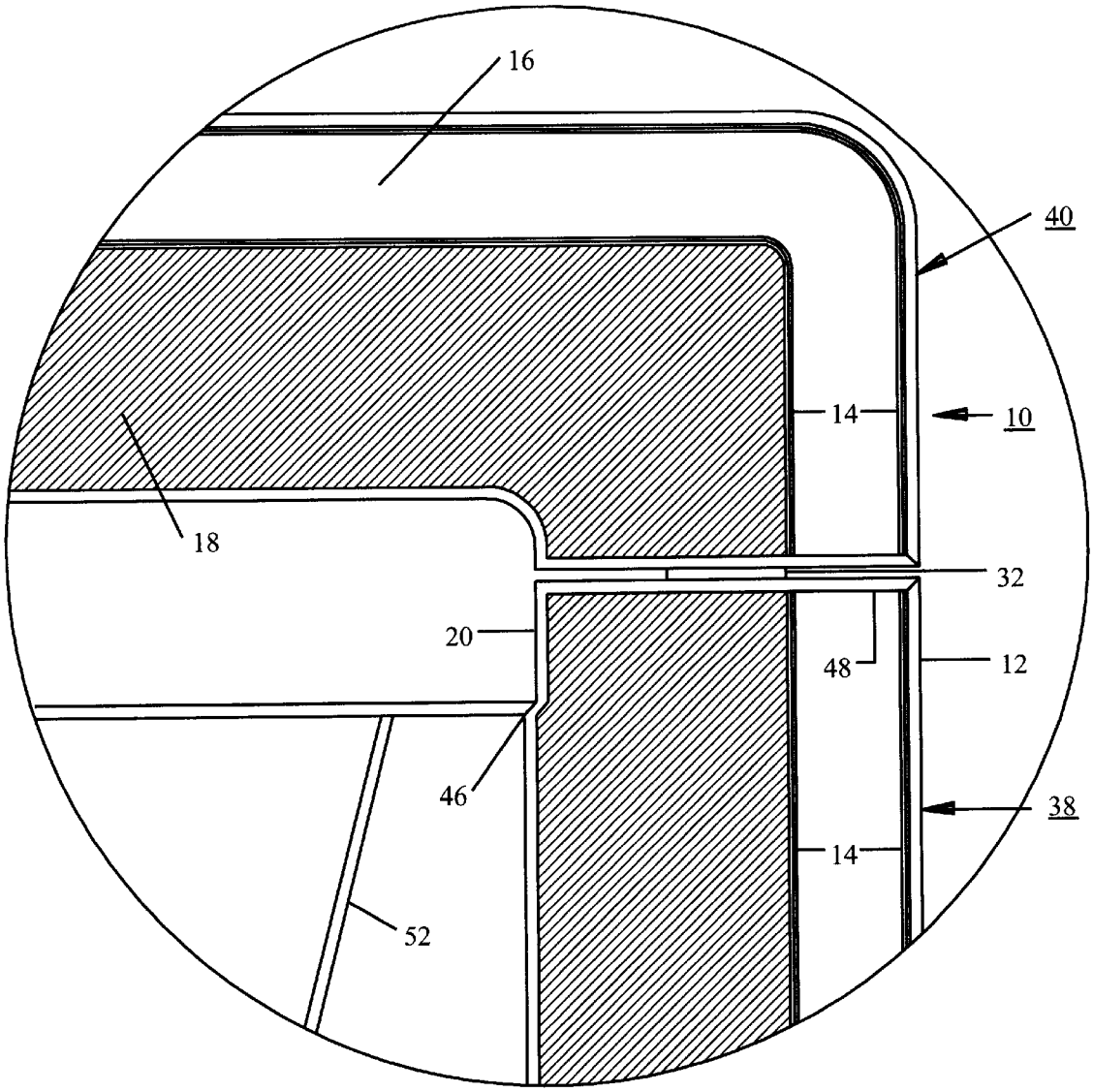
FIG. 5A is an enlarged, sectional view taken from FIG. 1 showing the lid assembly and cooler housing assembly interface and details of a cooler constructed according to an alternate embodiment of the present invention.

FIG. 5A shows another embodiment of the present invention that is similar to that illustrated in FIG. 5 except that an additional radiant barrier 14 is affixed to the outside of the insalating material 18. It should be noted that multiple layers of radiant barrier 14, in addition to the two layers of radiant barrier 14 shown in FIG. 5A, could be placed between the inner shell 20 and outer shell 12, or could be placed on the outside of the outer shell 12, but that multiple layers of radiant barrier 14 become less cost effective and show diminishing benefits.

FIG. 5 and FIG. 5A also illustrate the seal 32 being compressed between the lid assembly 40, and the seal land 48 of the cooler housing assembly 38. Ihe seal 32 is attached to the lid assembly 40 in a continuous rectangular loop so that the seal 32 makes continuous uninterrupted contact with the seal land 48 of the cooler housing assembly 38 when the lid assembly 40 is secured in the closed position by means of latches 30.

FIG. 1 and FIG. 2 illustrate the generally planar lid assembly 40 being attached to the back vertical wall of the outer shell 12 by means of two hinges 28. Hinges 28 are well known in the prior art and could be integrally molded into the lid assembly 40 and back vertical wall of the outer shell 12, or the hinges 28 could be independent pieces that are physically attached to the lid assembly 40 and to the back vertical wall of the outer shell 12. Likewise, FIG. 1 and FIG. 2 also illustrate the lid assembly 40 being locked into the closed position by means of two latches 30. Here again, latches are well known in the prior art and could be integrally molded into the lid assembly 40 and front vertical wall of the outer shell 12, or the latches 30 could be independent pieces that are physically attached to the lid assembly 40 and to the front vertical wall of the outer shell 12.

FIG. 1 and FIG. 2 also illustrate a drain hole 26 that passes from one vertical end wall of the outer shell 12 through the radiant barrier 14, air space 16, and insulating material 18, to the inner shell 20 near the bottom of the cooler housing assembly 38. Liquid can be drained from the storage area 22 by removing the drain plug 24 to allow liquid to pass through drain hole 26.

Figure 4:
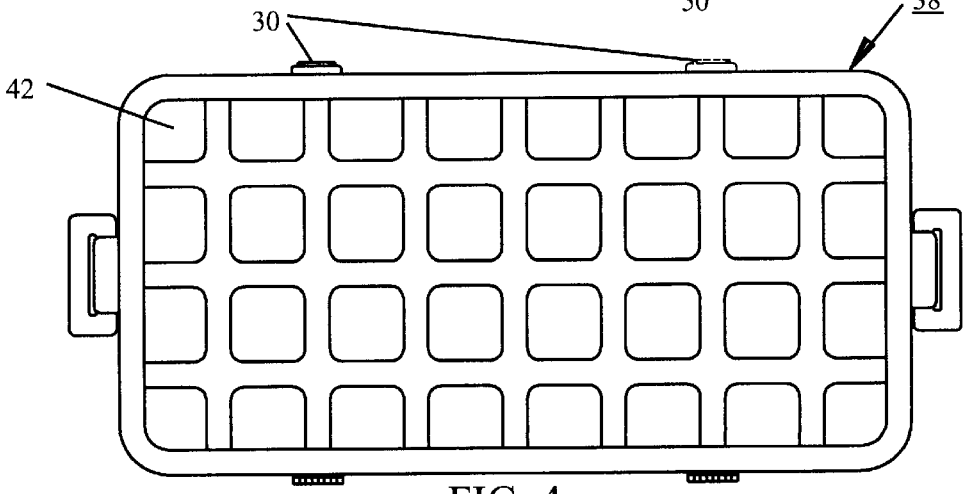
FIG. 4 is a bottom view of a cooler constructed according to the teachings of the present invention.

FIG. 3 illustrates the male stiffening ridge/interlocking feature 44 of the lid assembly 40. Similarly, FIG. 4 illustrates the female stiffening ridge/interlocking feature 42 of the cooler housing assembly 38. The male stiffening ridge/interlocking feature 44 and the female stiffening ridge/interlocking feature 42 are designed to provide strength and stiffness to the cooler assembly 10 and to provide a locking feature for convenient stacking of multiple cooler assemblies 10.

OPERATION OF THE INVENTION

A description of radiation and of a radiant heat barrier as shown in the drawings will aid in the understanding and operation of this invention.

Radiation is a unique and independent form of heat transfer that basically refers to the transmission of electromagnetic energy through space. While the term radiation applies to the entire electromagnetic spectrum, the portion that falls between visible light and radar, the infrared rays, are of primary concern in designing and building a more efficient and effective cooler.

Infrared rays are not themselves "hot", but are simply a particular frequency of pure electromagnetic energy. "Heat" does not occur until these rays strike an object, thereby increasing the motion of surface molecules. The heat then generated is spread to the interior of the object through conduction.

A radiant heat barrier works by reflecting radiant heat back toward the source. It does not reflect conducted heat, nor can it reflect heat within a solid object.

In keeping with the above description, FIG. 1 may be used to illustrate the operation of the cooler assembly 10. To operate this invention, beverages, food, medical supplies, drugs, or other heat sensitive products requiring storage at lower than ambient temperatures are placed in the storage area 22 of the cooler assembly 10 along with a cooling source such as ice. The lid assembly 40 is then locked to the cooler housing assembly 38 by means of two latches 30. During operation of the cooler assembly 10, up to 95% of the radiant heat that hits the cooler assembly 10 will be reflected back toward the source. Furthermore, the conductive heat flow of radiant energy that is not reflected by the radiant barrier 14, and is thus absorbed by the radiant barrier 14, will be retarded by the air space 16 thereby minimizing the negative effects of the conductive heat flow.

The air space 16 at the bottom of the cooler assembly 10 is particularly beneficial. The reason for this is that the majority of the heat transfer taking place at the bottom of the cooler assembly 10 results from the direct conductive contact of the cooler assembly 10 with the surface the cooler assembly 10 is sitting on. As a result, conductive heat flow will be retarded by the air space 16 at the bottom of the cooler assembly 10 thereby minimizing the negative effects of the conductive heat flow.

SUMMARY, RAMIFICATIONS, AND SCOPE

Accordingly, the reader will see that this invention provides a novel approach for improving the efficiency and effectiveness of a "cooler" or "chest". This is primarily achieved by incorporating a radiant heat barrier and air space into the design of the cooler to minimize the detrimental effects that radiant heat and conductive heat contribute in reducing the ability of the cooler to keep contents at lower than ambient temperatures. Furthermore, this invention will:

reduce the expense of purchasing ice or alternative cold source substances such as dry ice when operating the cooler.

reduce the expense of operating an electrically powered cold source, such as an electrical refrigerating system, when an electrically powered cold source is used in conjunction with the cooler.

increase the length of time the cooler is capable of effectively keeping its contents at lower than ambient temperatures when utilizing a given cold source.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements and compositions described herein or in the features or in the sequence of features of the methods described herein without departing from the spirit and scope of the invention as described in the following claims.

I claim:

1. A cooler assembly comprising:

(a) a cooler housing assembly for containment of objects, said cooler housing assembly having an inner shell and an outer shell, said inner shell of said cooler housing assembly having a bottom and side walls, said outer shell of said cooler housing assembly having a bottom and side walls, said inner shell of said cooler housing assembly and said outer shell of said cooler housing assembly terminating in an edge presenting a surface substantially parallel to said bottom of said maker shell of said cooler housing assembly and defining an opening, (b) a lid assembly spanning the distance between said inner side walls of said inner shell of said cooler housing assembly to at least partially close said opening, said lid assembly having an inner shell and an outer shell, said inner shell of said lid assembly having a top and side walls, said outer shell of said lid assembly having a top and side walls, said inner shell of said lid assembly and said outer shell of said lid assembly terminating in an edge presenting a surface substantially parallel to said top of said inner shell of said lid assembly, (c) a radiation barrier layer of material applied to the inner surfaces of said bottom and said side walls of said outer shell of said cooler housing assembly and inner surfaces of said top and said side walls of said outer shell of said lid assembly for reducing the amount of radiant energy that penetrates said inner shell of said cooler housing assembly and said inner shell of said lid assembly so as to minimize the detrimental effects of radiant energy and thereby improve the effectiveness of said cooler assembly.

2. The invention of claim 1 wherein a thermal insulating means is included between said radiation barrier layer of material and said inner shell of said cooler housing assembly and between said radiation barrier layer of material and said inner shell of said lid assembly for reducing heat transmission by conduction so as to minimize the detrimental effects of conductive heat and thereby improve the effectiveness of said cooler assembly.

3. The invention of claim 1 wherein an air space is included between said radiation barrier layer of material and said inner shell of said cooler housing assembly and between said radiation barrier layer of material and said inner shell of said lid assembly for reducing heat transmission by conduction so as to minimize the detrimental effects of conductive heat and thereby improve the effectiveness of said cooler assembly.

4. A cooler assembly comprising:

(a) a cooler housing assembly for containment of objects, said cooler housing assembly having an inner shell and an outer shell, said inner shell of said cooler housing assembly having a bottom and side walls, said outer shell of said cooler housing assembly having a bottom and side walls, said inner shell of said cooler housing assembly and said outer shell of said cooler housing assembly terminating in an edge presenting a surface substantially parallel to said bottom of said inner shell of said cooler housing assembly and defining an opening, (b) a lid assembly spanning tie distance between said inner side walls of said inner shell of said cooler housing assembly to at least partially close said opening, said lid assembly having an inner shell and an outer shell, said inner shell of said lid assembly having a top and side walls, said outer shell of said lid assembly having a top and side walls, said inner shell of said lid assembly and said outer shell of said lid assembly terminating in an edge presenting a surface substantially parallel to said top of said inner shell of said lid assembly, (c) a radiation barrier layer of material applied to the inner surfaces of said bottom and said side walls of said outer shell of said cooler housing assembly and inner surfaces of said top and said side walls of said outer shell of said lid assembly for reducing the amount of radiant energy that penetrates said inner shell of said cooler housing assembly and said inner shell of said lid assembly so as to minimize the detrimental effects of radiant energy and thereby improve the effectiveness of said cooler assembly.

(d) a thermal insulating means included between said radiation barrier layer of material and said inner shell of said cooler housing assembly and between said radiation barrier layer of material and said inner shell of said lid assembly for reducing heat transmission by conduction so as to minimize the detrimental effects of conductive heat and thereby improve the effectiveness of said cooler assembly.

5. The invention of claim 4 wherein an air space is included between said radiation barrier layer of material and said thermal insulating means of said cooler housing assembly and between said radiation barrier layer of material and said thermal insulating means of said lid assembly for reducing heat transmission by conduction so as to minimize the detrimental effects of conductive heat and thereby improve the effectiveness of said cooler assembly.

6. A cooler assembly comprising:

(a) a cooler housing assembly for containment of objects, said cooler housing assembly having an inner shell and an outer shell, said inner shell of said cooler housing assembly having a bottom and side walls, said outer shell of said cooler housing assembly having a bottom and side walls, said inner shell of said cooler housing assembly and said outer shell of said cooler housing assembly terminating in an edge presenting a surface substantially parallel to said bottom of said inner shell of said cooler housing assembly and defining an opening, (b) a lid assembly spanning the distance between said inner side walls of said inner shell of said cooler housing assembly to at least partially close said opening, said lid assembly having an inner shell and an outer shell, said inner shell of said lid assembly having a top and side walls, said outer shell of said lid assembly having a top and side walls, said inner shell of said lid assembly and said outer shell of said lid assembly terminating in an edge presenting a surface substantially parallel to said top of said inner shell of said lid assembly, (c) a radiation barrier layer of material applied to the inner surfaces of said bottom and said side walls of said outer shell of said cooler housing assembly and inner surfaces of said top and said side walls of said outer shell of said lid assembly for reducing the amount of radiant energy that penetrates said inner shell of said cooler housing assembly and said inner shell of said lid assembly so as to minimize the detrimental effects of radiant energy and thereby improve the effectiveness of said cooler assembly, (d) a thermal insulating means included between said radiation barrier layer of material and said inner shell of said cooler housing assembly and between said radiation barrier layer of material and said inner shell of said lid assembly for reducing heat transmission by conduction so as to minimize the detrimental effects of conductive heat and thereby improve the effectiveness of said cooler assembly, (e) an air space included between said radiation barrier layer of material and said thermal insulating means of said cooler housing assembly and between said radiation barrier layer of material and said thermal insulating means of said lid assembly for reducing heat transmission by conduction so as to minimize the detrimental effects of conductive heat and thereby improve the effectiveness of said cooler assembly.

7. The invention of claim 6 wherein an additional radiation barrier layer of material is applied to said thermal insulating means at surfaces that are opposite said inner shell of said cooler housing assembly and to said thermal insulating means at surfaces that are opposite said inner shell of said lid assembly for reducing the amount of radiant energy that penetrates said inner shell of said cooler housing assembly and said inner shell of said lid assembly so as to minimize the detrimental effects of radiant energy and thereby improve the effectiveness of said cooler assembly.

8. The invention of claim 6 wherein a plurality of radiation barrier layers of material are spaced at intervals between said radiation barrier layer of material and said thermal insulating means to partially occupy said air space of said cooler housing assembly and between said radiation barrier layer of material and said thermal insulating means to partially occupy said air space of said lid assembly for reducing the amount of radiant energy that penetrates said inner shell of said cooler housing assembly and said inner shell of said lid assembly so as to minimize the detrimental effects of radiant energy and thereby improve the effectiveness of said cooler assembly.

* * * * *

UNITED STATES PATENT AND TRADEMARK OFFICE

CERTIFICATE OF CORRECTION

PATENT NO. : 6,003,719

DATED : Dec. 21, 1999

INVENTOR(S) : John R. Stewart III

It is certified that error appears in the above-identified patent and that said Letters Patent is hereby corrected as shown below:

Column 5, line 29, change "insalating" to --insulating--.

Column 5, line 38, change "Ihe" to --The--.

Column 7, line 39, change "maker" to --inner--.

Column 8, line 24, change "tie" to --the--.

Signed and Sealed this

Tenth Day of April, 2001

*Attest:*

Nicholas P. Godici

NICHOLAS P. GODICI

*Attesting Officer*

*Acting Director of the United States Patent and Trademark Office*